US007601072B2

(12) United States Patent
Nelson

(10) Patent No.: US 7,601,072 B2
(45) Date of Patent: Oct. 13, 2009

(54) GOLF TRAINING AID

(75) Inventor: Steven G. Nelson, Springville, UT (US)

(73) Assignee: Golf Swing Concepts International, LLC, Highland, UT (US)

( * ) Notice: Subject to any disclaimer, the term of this patent is extended or adjusted under 35 U.S.C. 154(b) by 0 days.

(21) Appl. No.: 12/157,400

(22) Filed: Jun. 10, 2008

(65) Prior Publication Data

US 2008/0248891 A1 Oct. 9, 2008

(51) Int. Cl.
*A63B 69/36* (2006.01)

(52) U.S. Cl. ..... 473/219; 473/226; 473/229

(58) Field of Classification Search ..... 473/212, 473/218, 219, 224, 227, 229, 226; 482/112
See application file for complete search history.

(56) References Cited

U.S. PATENT DOCUMENTS 5,005,836 A * 4/1991 Nelson ..... 473/229
5,888,146 A * 3/1999 Raynak ..... 473/229
6,402,632 B2 * 6/2002 Hope et al. ..... 473/218

* cited by examiner

*Primary Examiner*—Nini Legesse
(74) *Attorney, Agent, or Firm*—Colter Jennings

(57) ABSTRACT

A golf driving and putting training aid comprises a driving module, a short-putt module, a long-putt module, and a third putting module. The driving module includes a shaft of telescoping cylinders pivotally secured at one end to a supporting surface and provided with a driving handle at the other end. The rate of retraction and extension of all cylinders is controlled by felt strips restricting the flow of air between the cylinders. The direction of the swing is controlled by pivoting joints by which the cylinders are connected to the supporting surface and to the handle. In one embodiment, the cylinders are pivotally attached to a slidable sleeve that glides along a horizontal bar. The movement of the sleeve can be restricted along the horizontal bar. The short-putt module includes a telescoping cylindrical shaft that is attached to the user's putter. When used, the short-putt module forces the user to keep the short-putt stroke straight. The long-putt module includes an arcuate guide to which a putter may be attached, thereby requiring the user to use the proper arcuate stroke for a long putt. Another putting module includes use of a mounting assembly that connects a putter to a horizontal bar. This embodiment allows movement of the putter along a generally defined arc that allows a slight transverse or perpendicular movement of the putter during the stroke.

18 Claims, 13 Drawing Sheets

FIG. 1
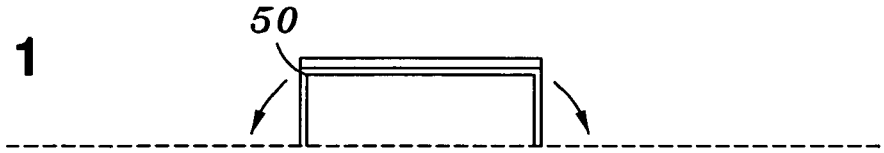
FIG. 2
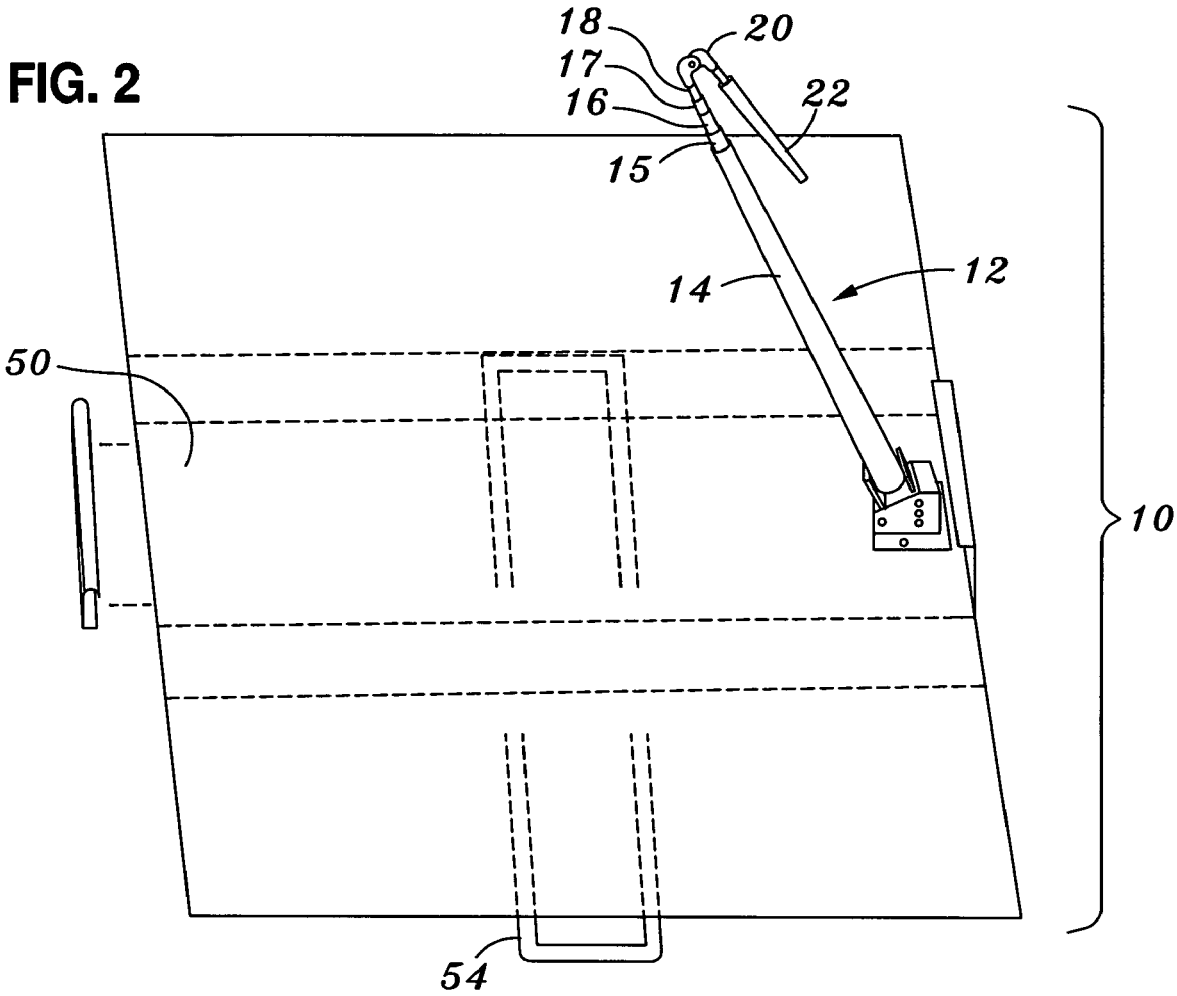
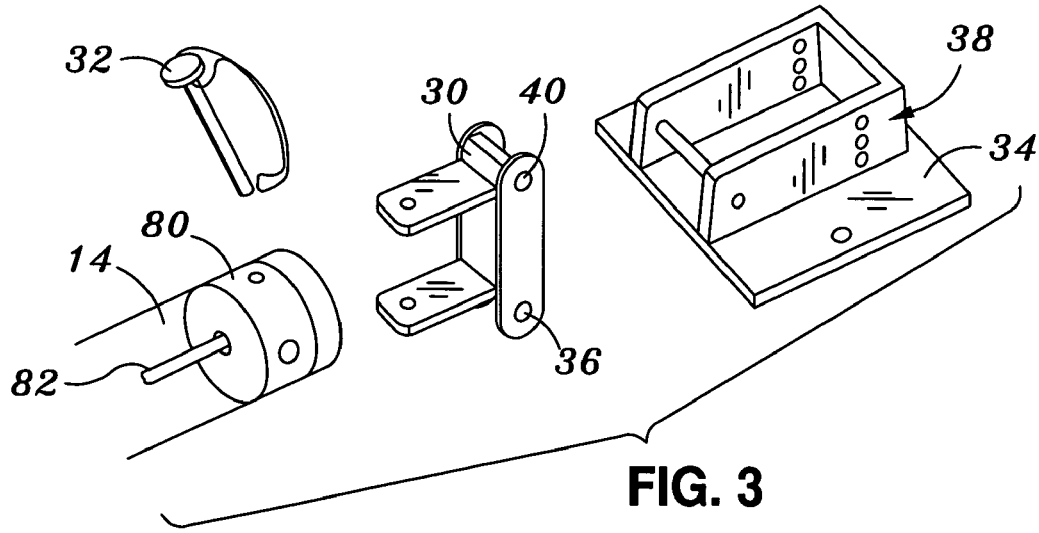
FIG. 3

GOLF TRAINING AID

CROSS-REFERENCE TO RELATED APPLICATION

This application claims priority based on U.S. Provisional Patent Application Ser. No. 60/684,643 filed May 25, 2005 and titled "Golf Training Aid" and on U.S. application Ser. No. 11/883,284 for "Golf Training Aid," which was based on International Application No. PCT/06US/18673, the disclosures of all of which are hereby incorporated by reference.

BACKGROUND

This application discloses a golf training apparatus that develops a golfer's swing by refining the three components of an effective swing: form, speed and placement. An effective golf swing requires constant practice and refinement of these three components. The apparatus disclosed can be used indoors or outdoors to practice the varied aspects of different golf swings, allowing a golfer to maintain or increase proficiency through a regular training regimen.

Many devices for practicing golf swings have been developed, including those disclosed in U.S. Pat. No. 3,083,016 to Sumegi; U.S. Pat. No. 3,351,346, to Strahan; U.S. Pat. No. 3,999,765 to Bishop; and U.S. Pat. No. 4,486,020 to Kane et al. These devices allow for the practice of a golf swing, but they lack the adaptability, flexibility, and ease of use of the apparatus disclosed in U.S. Pat. No. 5,005,836 to Nelson.

Although the Nelson patent constitutes a marked improvement over prior practice devices, its design is overly complicated and lacks finely tuned guidance. An advanced degree of form correction, combined with flexibility and ease of use, is not taught or suggested by any of the prior patents.

SUMMARY

The present apparatus provides a golf swing training device that corrects form and placement in golf driving as well as in putting. The present apparatus includes a golf driving and putting exerciser and training aid for on-course and off-course use. The apparatus helps strengthen a golfer's swing as well as improve the timing, rhythm and positions of the club during the swing.

The present apparatus includes multiple modules enabling use in many environments. A driving module includes a series of telescoping cylinders pivotally secured at one end to a supporting surface and pivotally secured at the other end to a handle. The telescoping cylinders are extended in an angled vertical direction to the backswing position. During the downswing, the cylinders collapse with a controlled amount of resistance to provide the "feel" a golfer experiences with a regular golf swing using a club. The joint between the cylinders and the driving handle, as well as the design of the collapsing guiding rod, generally confine the golf swing to an optimized swing pattern.

The design of the cylinders, including the interaction and the two pivot points, guides the golfer within the correct swing plane throughout the swing. Relative inflexibility in the device renders an incorrect golf swing difficult if not impossible. Thus, repeated practice with the device helps establish correct muscle memory and assists in limiting incorrect golf swing habits. One embodiment of the driving module includes a strap that can be attached to a golf bag, so that the golfer may use the device as an on-course practice aid. Another embodiment includes a horizontal bar to which the cylinders are slidably connected, so that the lower end of the cylinder assembly may slide along a plane near ball placement.

A short-putt module includes a horizontal telescoping tube that allows a golfer to practice the straight stroke required for short putting situations. A long-putt module adds a curved guide tube that allows a golfer to practice the slightly curved stroke required for longer putting situations. Another putting module includes braces that connect the putter to a horizontal bar; the putter is thereby guided along a path that promotes a good putting stroke. Thus, the present apparatus provides training modules for each general type of swing necessary for playing golf.

BRIEF DESCRIPTION OF THE DRAWINGS

Other features and advantages of the present apparatus will be apparent from reference to specific embodiments as presented in the following Detailed Description taken in conjunction with the accompanying Drawings, in which:

FIG. 1 is an end view of a boxed driving module according to one embodiment;

FIG. 2 is a perspective view of a driving module according to one embodiment;

FIG. 3 is an exploded close-up perspective view of a lower portion of the driving module of FIG. 2;

FIG. 24 is a cut-away view perspective of a putting module in accordance with another embodiment;

DETAILED DESCRIPTION

Figure 4:
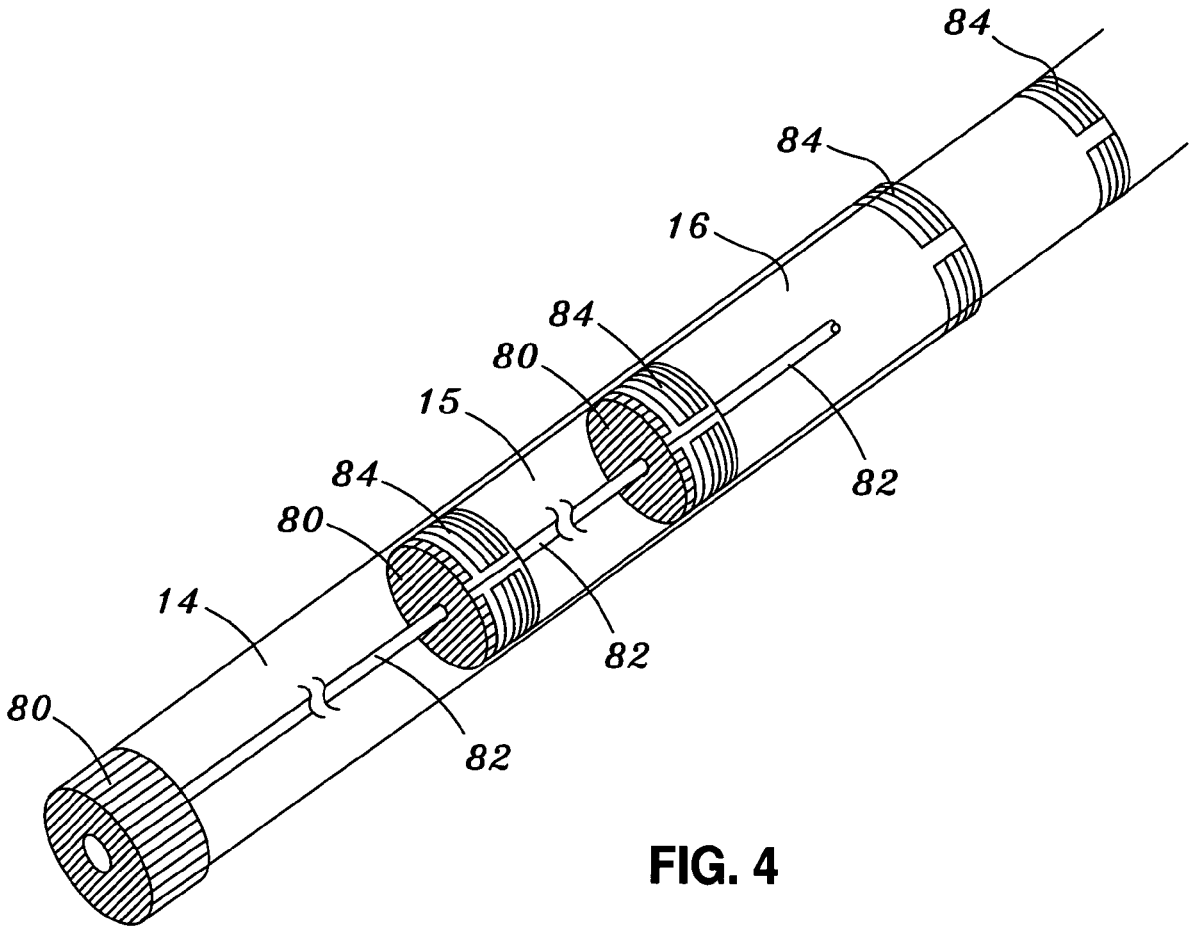
FIG. 4 is a cut-away view of an intermediate section of the driving module of FIG. 2.

The present apparatus includes a golf training aid having a driving module 10, a long putt module, and a short putt module. As depicted in the drawings, and in particular in FIG. 2, the driving module 10 has a longitudinal shaft 12 formed by a series of nesting telescoping cylinders. In the embodiment shown in FIG. 2, the shaft 12 includes a first cylinder 14 having a relatively large diameter, and second, third, and fourth intermediate cylinders 15, 16, and 17, each of decreasing diameter, and a fifth cylinder 18 of smallest diameter.

According to one embodiment, the largest cylinder 14 has a diameter of one inch and the smallest cylinder 18 has a diameter of one-half inch. The other cylinders have diameters that decrease by one-eighth inch for each, thus seven-eighths inch for the second intermediate cylinder 15, three-quarters inch for the third intermediate cylinder 16, and five-eighths inch for the fourth intermediate cylinder 17. The cylinders may be made of numerous materials, including titanium alloys or plastic, depending on the desired qualities of the end product. According to one embodiment, the cylinders are made of 6061-T6 tempered aluminum tubing with a consistent wall thickness of 0.035 inches throughout the length of each.

The upper end of the fifth cylinder 18 is attached by a pivotal joint 20 to a handle 22 that has a shape that assists a user in properly gripping a golf club. The pivotal joint 20 allows movement of the handle 22 in only a limited swing plane of movement in relation to the longitudinal shaft 12. Thus, the pivotal joint 20 causes a user to follow this plane of movement in using the module, thereby largely preventing rolling of the hands or wrists in either direction outside this plane.

Figure 7:
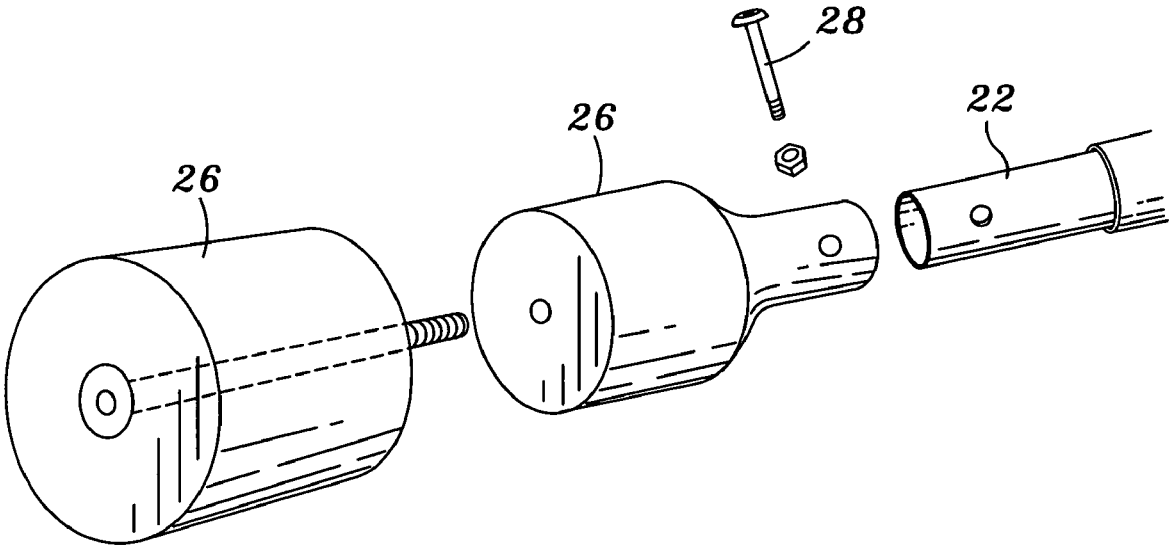
FIG. 7 is a perspective view of grip weights according to one embodiment.
Figure 8:
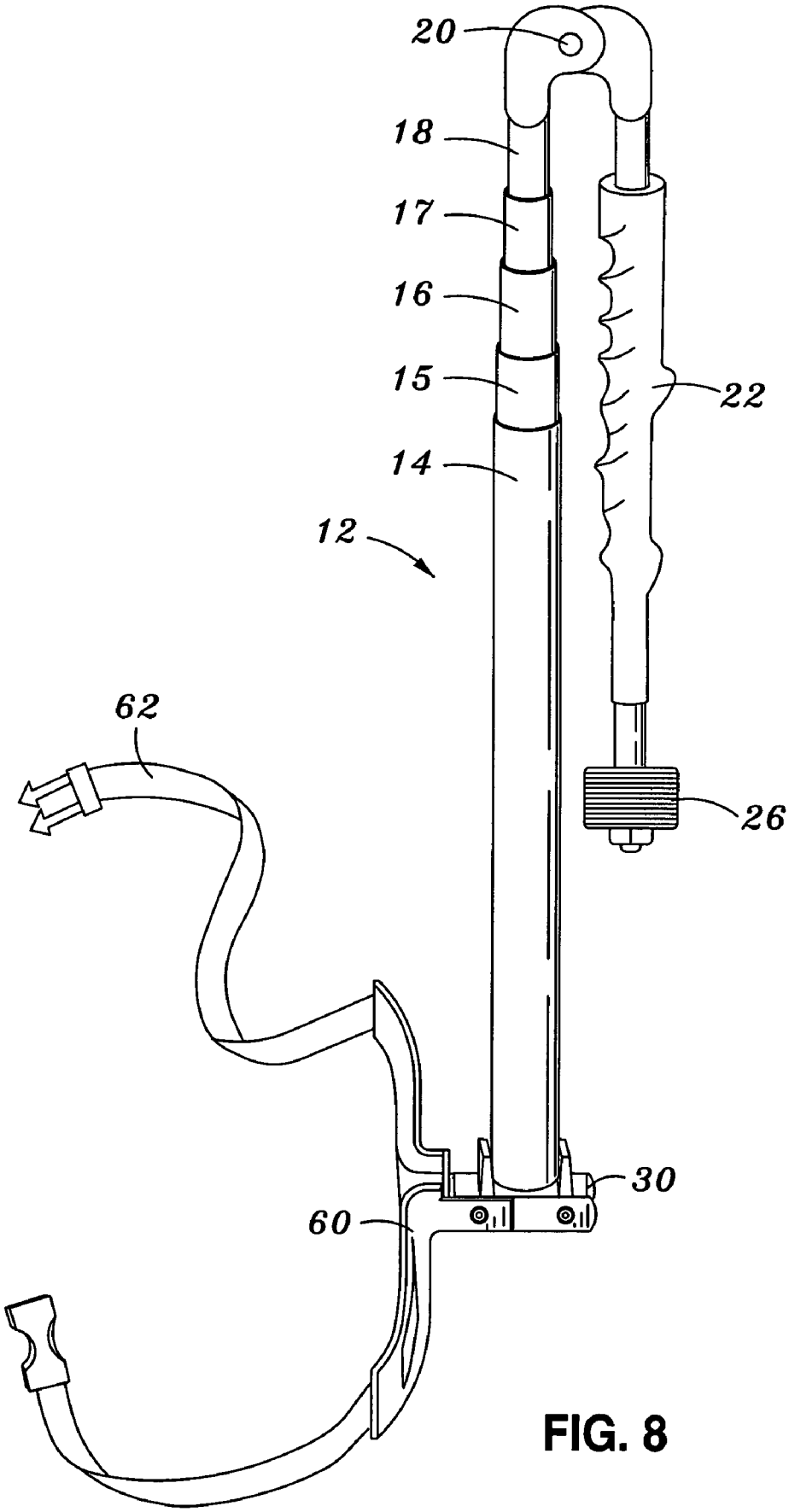
FIG. 8 is a perspective view of the driving module including a bag strap according to one embodiment.

The handle 22 is made of one-half inch diameter tempered aluminum. As shown in FIGS. 2 and 8, the end of the handle 22 opposite the pivotal joint 20 is attached to one or more removable weights 26. In the embodiment shown in FIG. 7, a weight mounting pin 28 retains the weights 26, but other attachments such as a clip-on, bayonet or other mount, may be used. Adding weight to the handle 22 progressively limits the breadth of the swing plane by amplifying the effects of the pivotal joint 20, because incremental weight increases incrementally prohibit the golfer from deviating from the proper swing plane. The increased weight further provides increased physical feedback to the golfer during the swing.

As depicted in FIG. 3, the lower end of the first cylinder 14 is pivotally attached to a U-shaped bracket 30. A quick release pin 32 attaches the U-shaped bracket 30 to a mounting housing 34 at a first pivot point 36. The mounting housing 34 has a plurality of holes 38, to which a second pivot point 40 of the U-shaped bracket 30 may be mounted.

Incorporating a plurality of holes 38 for mounting the second pivot point 40 permits the longitudinal shaft 12 to be affixed to the mounting housing 34 in a plurality of predetermined angular positions. Thus, the driving module permits swings along a plurality of distinct planes of movement, thereby accommodating users having differing heights, limb proportions, and stances.

As depicted in FIGS. 15 through 21, the mounting housing 34 and U-shaped bracket 30, together with the pivotal joint 20, restrict movement of the longitudinal shaft 12 and handle 22 to the directions and planes specific to a proper golf swing. A user 44 begins at what is called the address position (see FIG. 15). As the user 44 begins the back-swing (see FIG. 16), the pivotal joint 20 sets the position, angle, and movement of the wrists.

At the top of the back-swing (FIG. 17), and throughout the down-swing (FIGS. 18 and 19), the restrictions on movement inherent in the driving module 10 keep the user's arms and body in the proper position. At the end of the down-swing, the user 44 passes through the address position to the position the user would have at the moment of impact of the golf club face with the golf ball (FIG. 20) and on through the follow-through (FIG. 21) of the stroke. During this entire stroke, the restrictions on rotation and movement created by the U-shaped bracket 30 and the mounting housing 15 aid the user in maintaining proper swing form, even during the follow-through swing.

According to one embodiment, the mounting housing 34 may be attached to a driving module base 50 as shown in FIG. 2. The driving module base 50 may be folded as shown in FIG. 1 for storage or travel and carried with a driving module carrying handle or strap 54 such as that shown in FIG. 2.

Figure 5:
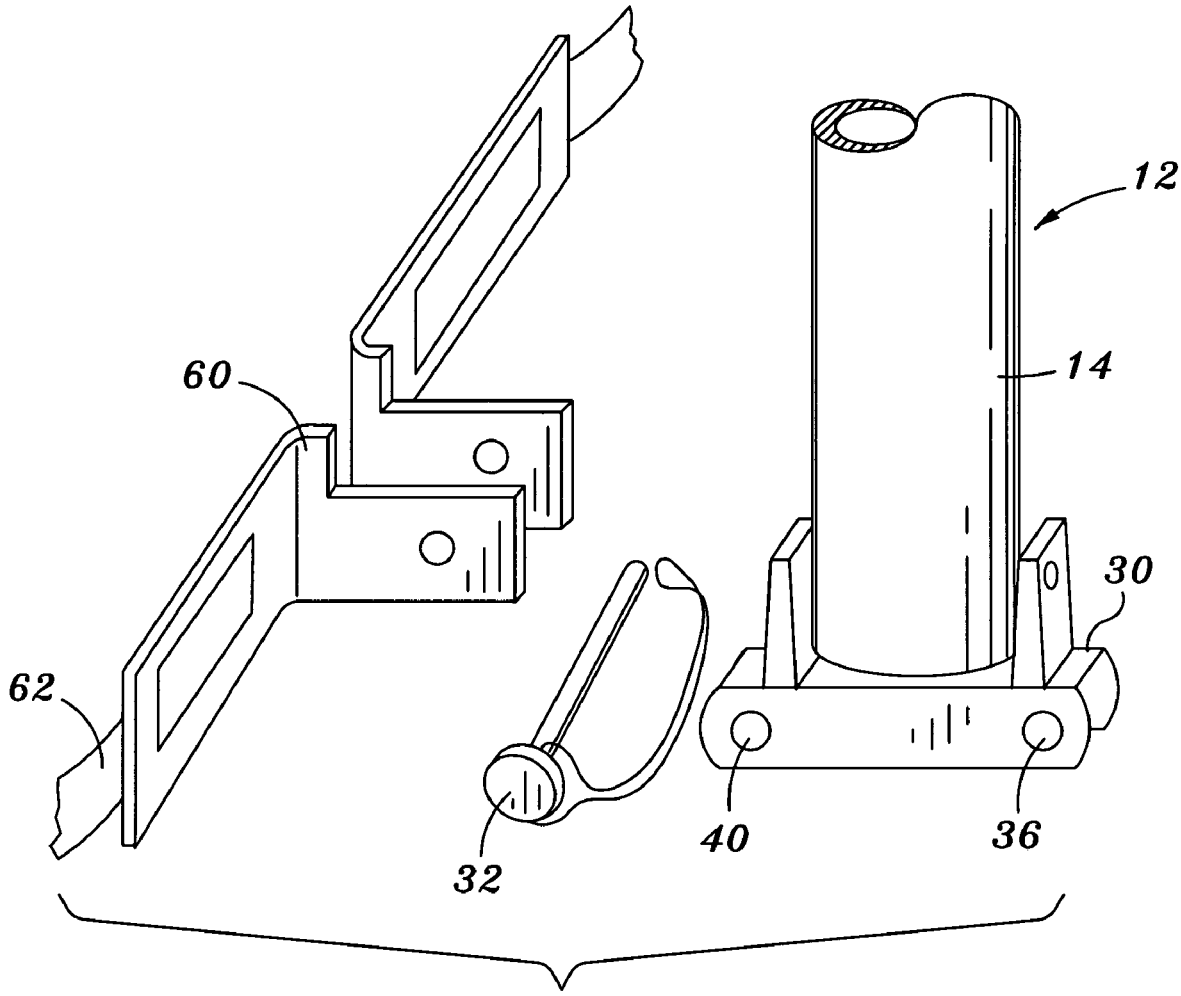
FIG. 5 is a exploded close-up perspective view of a lower portion of the driving module according to another embodiment.
Figure 6:
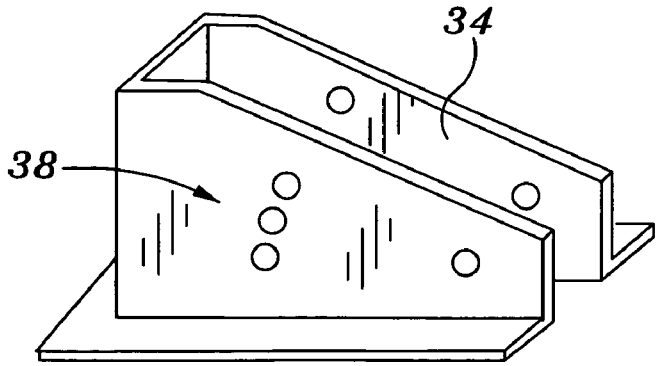
FIG. 6 is a perspective view of a housing according to one embodiment.
Figure 9:
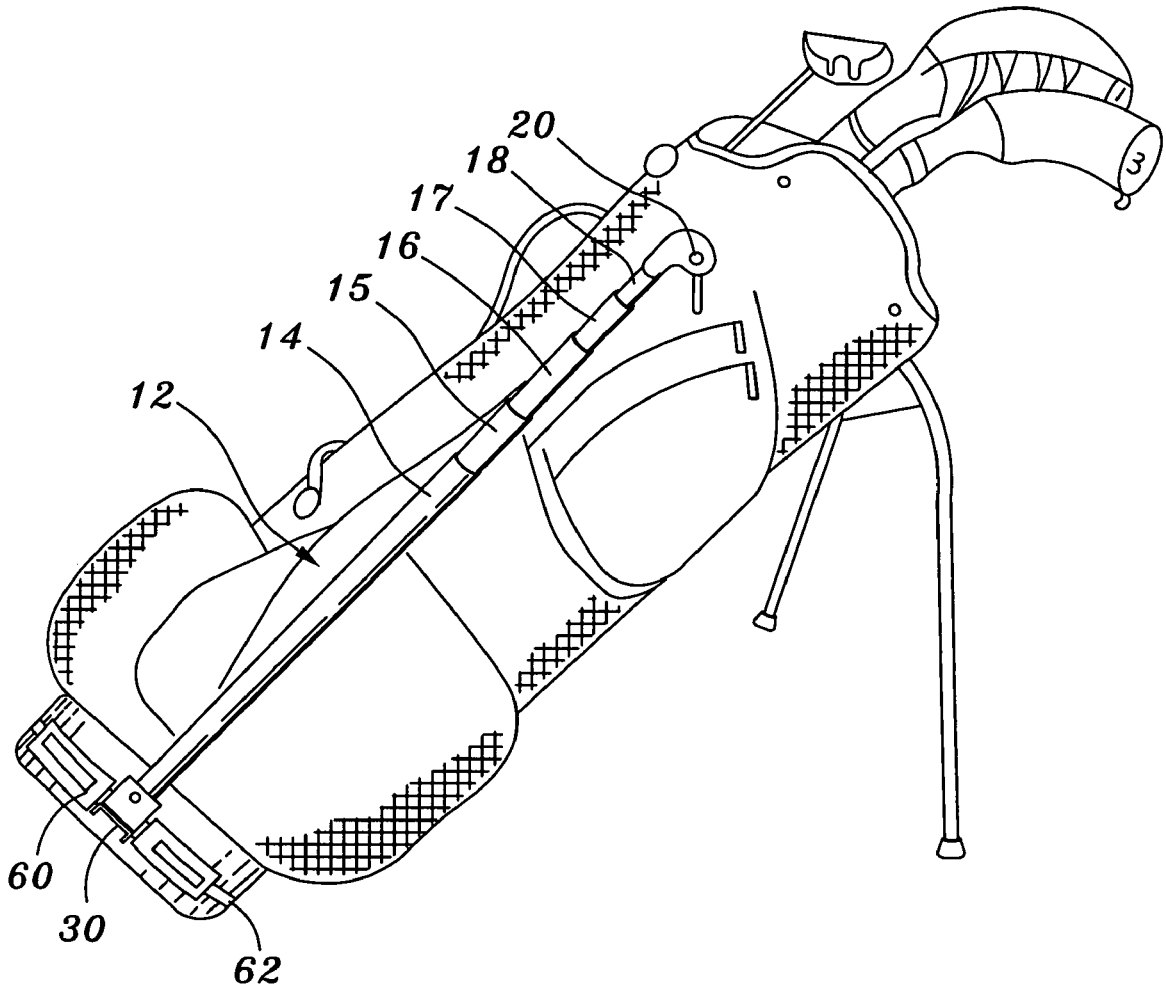
FIG. 9 is a perspective view of the driving module attached to a golf bag according to one embodiment.

In another embodiment, and as depicted in FIGS. 5, 8, and 9, the U-shaped bracket 30 may be removably affixed to a golf bag bracket 60 that may be secured to a golf bag strap 62. The golf bag bracket 60 is removably attached to the longitudinal shaft 12 by securing the second pivot point 40 of the U-shaped bracket 30 to the golf bag bracket 60, using the quick release pin 32. Thus, a user may conveniently carry the driving module onto a golf course, attached to the user's golf bag, for practice swings during actual play.

Figure 14:
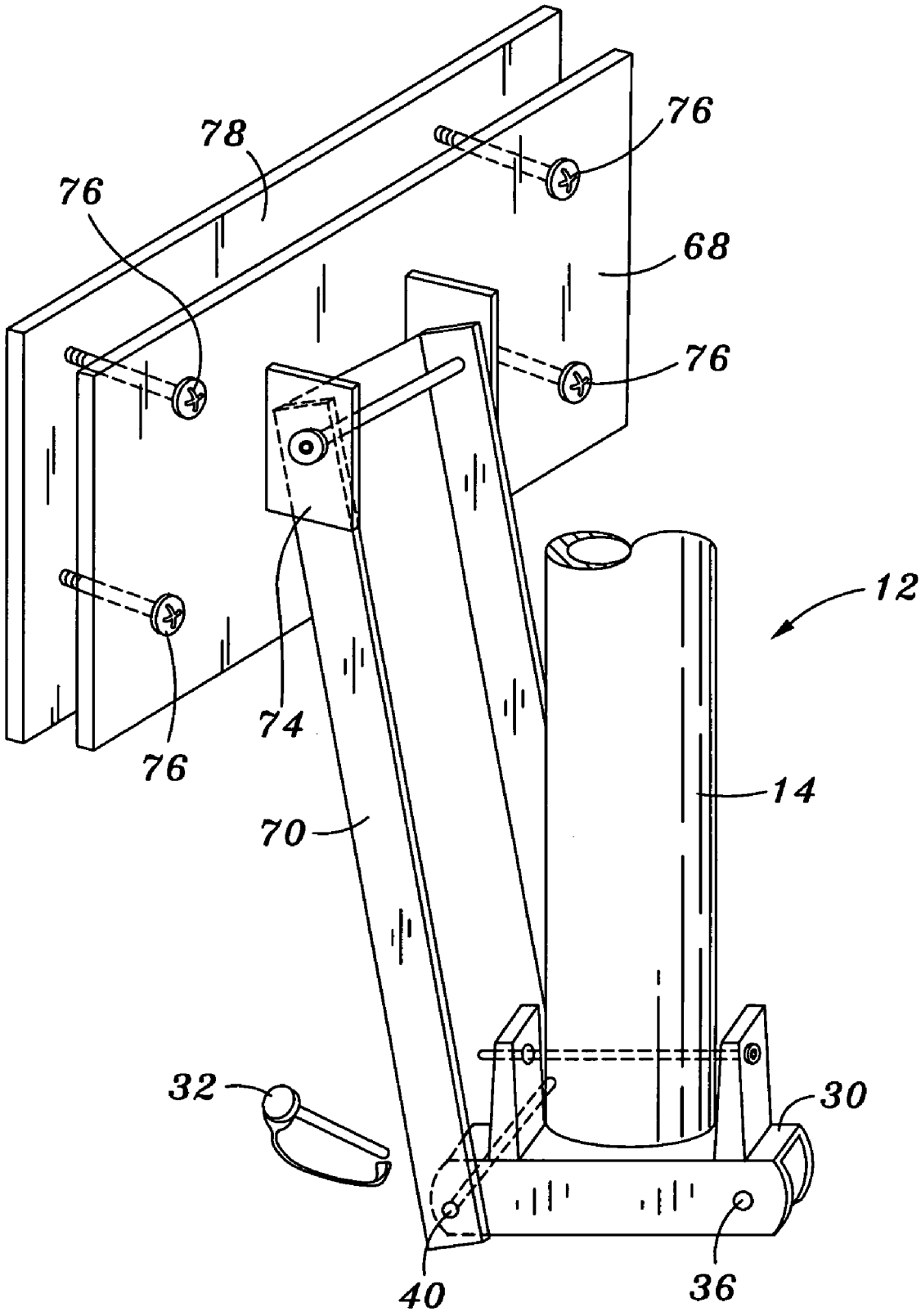
FIG. 14 is a perspective view of a golf cart attachment for the driving module of FIG. 2 according to another embodiment.
Figure 15:
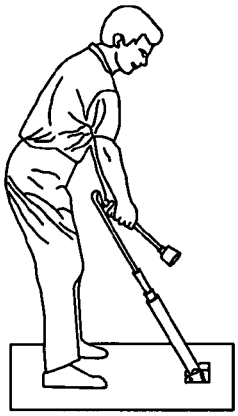
FIG. 15 is a perspective view of a right-handed golfer using the driving module, in the address position.
Figure 16:
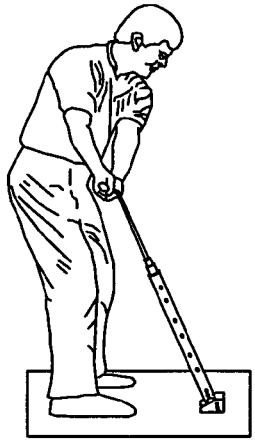
FIG. 16 is a perspective view of a right-handed golfer using the driving module, in the middle of the back-swing.
Figure 17:
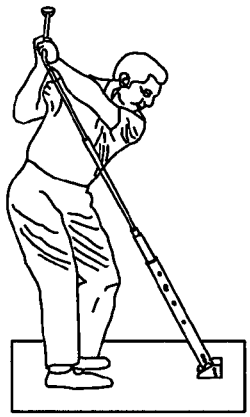
FIG. 17 is a perspective view of a right-handed golfer using the driving module, at the top of the back-swing.
Figure 18:
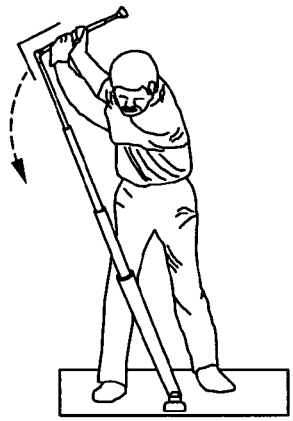
FIG. 18 is a perspective view of a right-handed golfer using the driving module, at the beginning of the downward swing.
Figure 19:
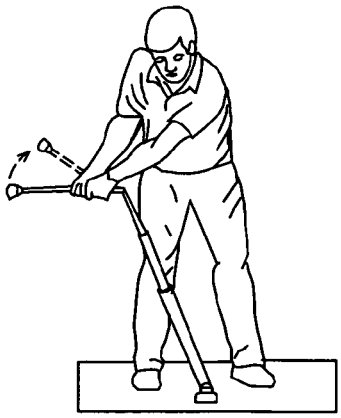
FIG. 19 is a perspective view of a right-handed golfer using the driving module, in the middle of the downward swing.
Figure 20:
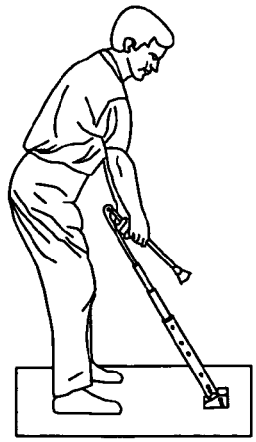
FIG. 20 is a perspective view of a right-handed golfer using the driving module, in the impact position.
Figure 21:
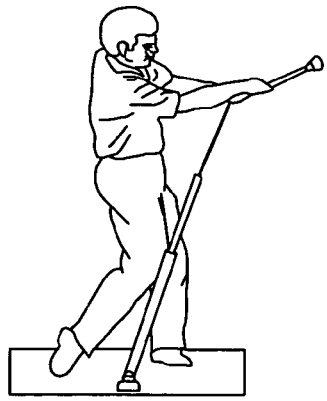
FIG. 21 is a perspective view of a right-handed golfer using the driving module, in the follow-through position.

As depicted in FIG. 14, according to another embodiment, the U-shaped bracket 30 of the driving module 10 may be removably affixed to a golf cart mounting assembly 64 that may be mounted on the side of a golf cart. The mounting assembly 64 includes a front bracket plate 68 having a hinged arm 70 thereon. The longitudinal shaft 12 may be removably attached to the hinged arm 70 by securing the second pivot point 40 of the U-shaped bracket 30 to the hinged arm 70 using the quick release pin 32.

When not attached to the U-shaped bracket 30, a bracket hinge point 74 permits the hinged arm 70 to swing up against the front bracket plate 68 and thus against the golf cart. Bolts 76 connect the front bracket plate 68 to a back bracket plate 78 and thus to the side of the golf cart. By affixing the unobtrusive golf cart mounting assembly 64 to a golf cart, a user may attach the driving module 10 to the golf cart to permit use of the driving module for practice swings while on a golf course.

Figure 22:
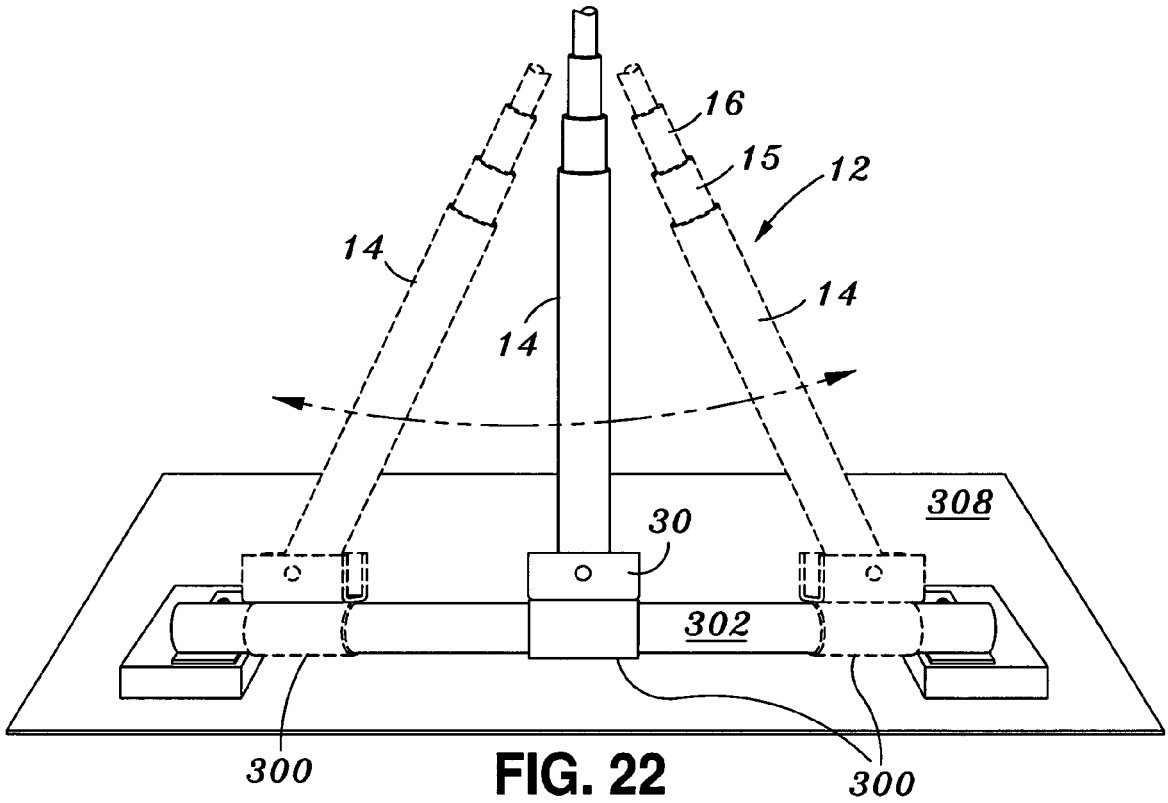
FIG. 22 is a front view of a horizontal bar connection for the driving module showing a sliding bracket in three positions along the horizontal bar.
Figure 23:
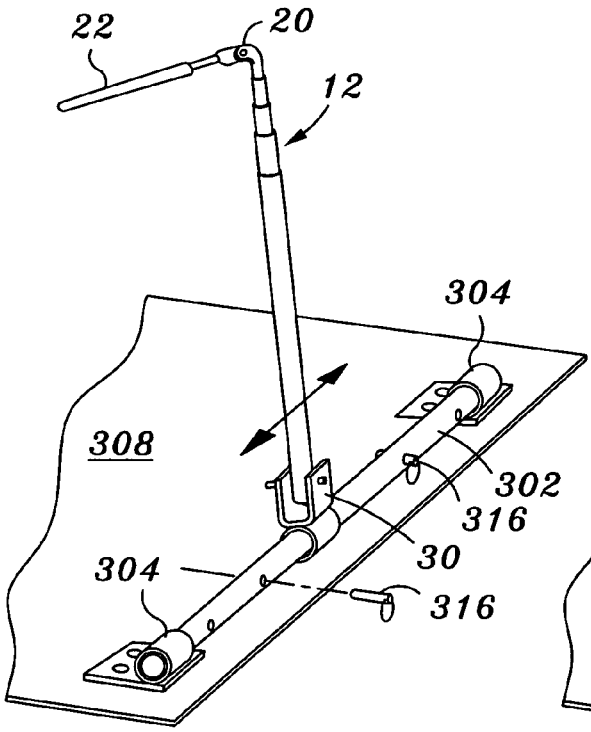
FIG. 23 is a perspective view of the driving module of FIG. 22 showing pins used to restrict lateral motion.
Figure 24:
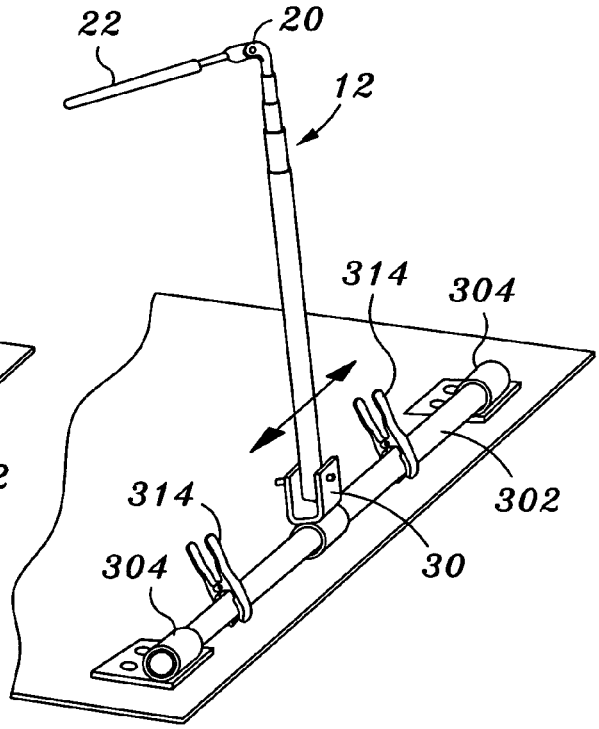
FIG. 24 is a perspective view of the driving module of FIG. 22 showing clips used to restrict lateral motion.

As depicted in FIGS. 22-24, according to yet another embodiment, a hollow sleeve 300 formed into the U-shaped bracket 30 is slidably coupled to a horizontal bar 302. Braces 304 at each longitudinal end support the horizontal bar 302 on a surface, such as on a strip of carpet 308. By using a carpet, the entire assembly may be made portable, and in fact the driving module may be wrapped up in the carpet for transport. However, the braces 304 could be mounted to a floor or to the base surface of a driving range if portability is not important.

Figure 25:
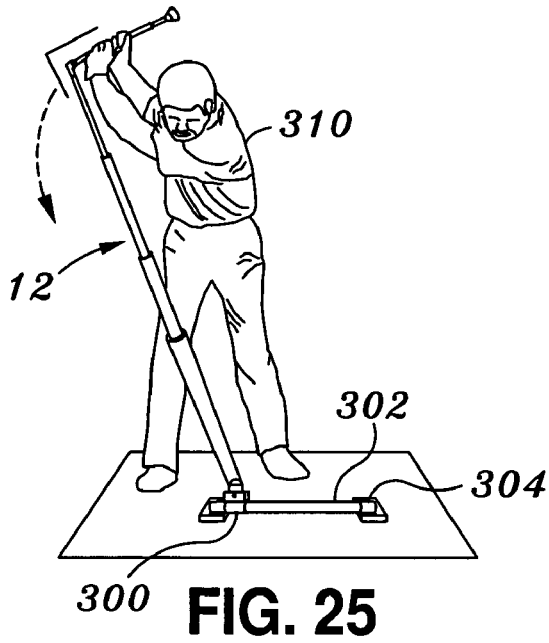
FIG. 25 is a perspective view of a right-handed golfer using the driving module of FIG. 22, at the top of the back-swing.
Figure 26:
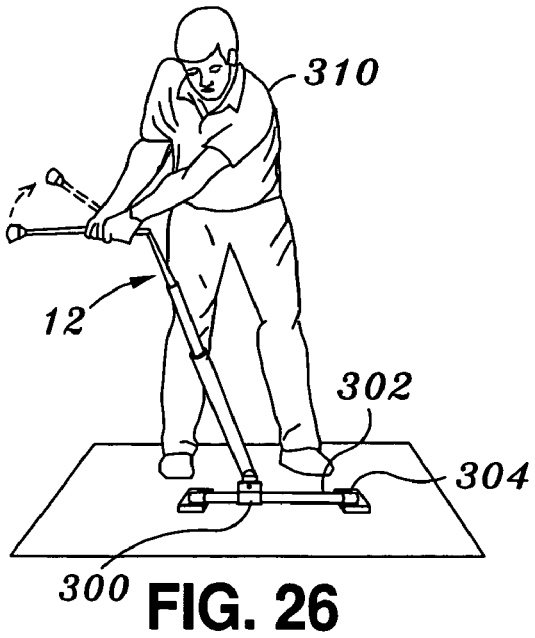
FIG. 26 is a perspective view of a right-handed golfer using the driving module of FIG. 22, at the beginning of the downward swing.
Figure 27:
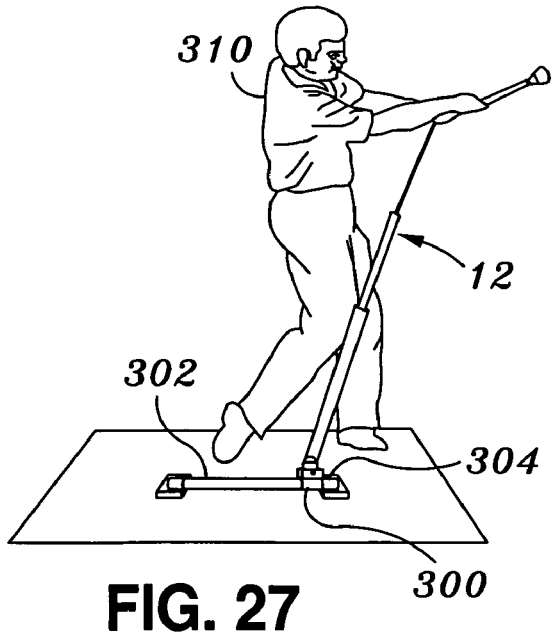
FIG. 27 is a perspective view of a right-handed golfer using the driving module of FIG. 22, in the follow-through position.

Operation of the sliding sleeve 300 is depicted in FIG. 22 and in FIGS. 25-27. As a golfer 310 draws the shaft 12 into a backswing (FIG. 25), the sliding sleeve 300 glides along the horizontal bar 302 until it hits the brace 304. As the golfer brings the shaft 12 through a golf swing (FIG. 26), the sleeve 300 glides along the horizontal bar 302 through the address position until it strikes the other brace 304 (FIG. 27). By allowing the sleeve 300 to slide along the horizontal bar 302, the golfer may return to a position where the club face is square to the back of the sleeve, thereby widening the bottom of the arc of the club, bringing the club face square at the point of impact, and reducing the amount of rotation of the golfer's hands. In effect, the sliding sleeve assists in bringing the club face back to a square position along the length of the horizontal bar. This greatly increases the effectiveness of the driving module in developing proper muscle memory.

Another advantage of the embodiment shown in FIGS. 23 and 24 is that clips 314 or quick release pins 316 may be inserted into the horizontal bar 302 to restrict sliding of the sleeve 300 in one or both directions. By using the clips 314 or pins 316, the driving module shown in FIG. 23 or 24 may be essentially converted into a module similar to that shown in FIG. 2. However, by using just one clip 314 or pin 316, the driving module may be used to correct a hook or slice, or to develop a fade (controlled slice) or a draw (controlled hook).

That is, by putting a clip 314 or pin 316 on the follow-through or target side of the swing (that is, the side toward the direction the ball is to be driven), the pin (or clip) will make the golfer close the club face and teach the golfer to impart draw (hook) spin to the ball. Similarly, by putting a pin (or clip) on the backswing (that is, the side away from the direction the ball is to be driven), the bottom of the stroke arc is set at that location, flattening the arc at that point. The golfer is thereby assisted (even forced) to utilize the hinges 20 of the module, which will assist the golfer in learning to develop a fade on the golf ball.

As depicted in FIG. 4, the cylinders 14, 15, 16, 17 and 18 forming the longitudinal shaft 12 each have an upper and lower end and a hollow interior. The lower end of each cylinder fits snugly into the upper end of the adjacent cylinder. Each of the cylinders has a plug 80 inside its lower end. The plug 80 of the first cylinder 14 is attached to one end of a nylon cord 82 that passes through the plugs 80 of the second cylinder 15, third cylinder 16, and fourth cylinder 17. The other end of the nylon cord 82 is attached to the plug 80 of the fifth cylinder 18.

The interior upper ends of the cylinders 14, 15, 16, 17 and 18, and the exterior lower ends of cylinders 4 through 7 are all lined with felt strips 84. The felt strips 84 control the air flow between the cylinders and the air flow entering and exiting the cylinders through gaps in the felt strips 84 at the top of each of cylinders 14, 15, 16, 17 and 18 as the longitudinal shaft 12 telescopes and collapses. The felt strips 84 also add friction in any movement of the cylinders, creating resistance that strengthens a user's golf swing.

Figure 10:
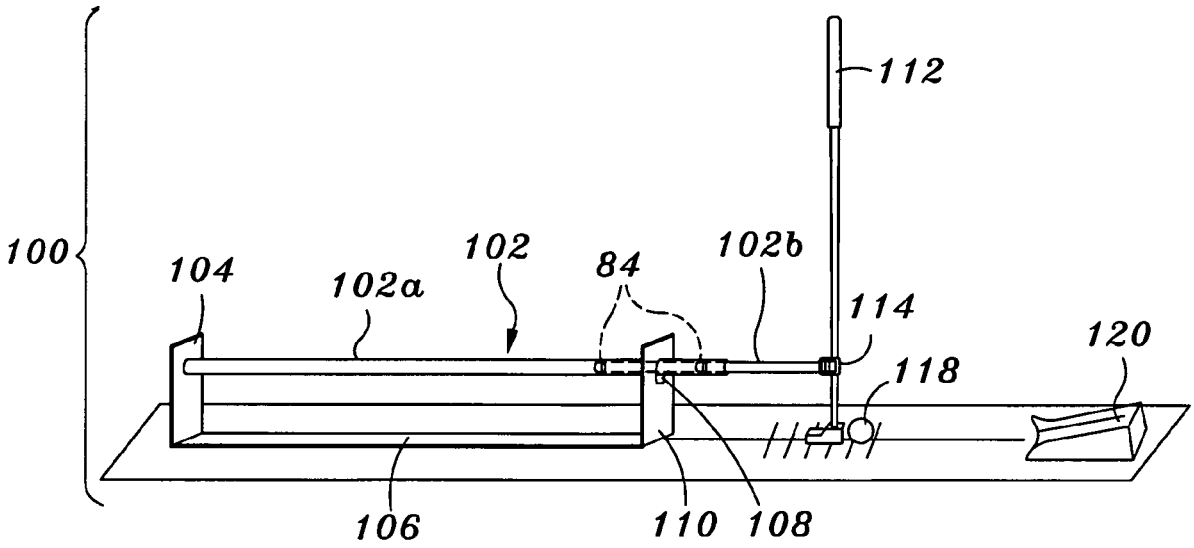
FIG. 10 is a perspective view of a short-putt module according to one embodiment.

As shown in FIG. 10, another embodiment includes a short-putt module 100 used to develop short putting skills. The short-putt module 100 comprises a telescoping assembly 102 that has a stationary tube 102*a* and a movable tube 102*b*. Preferably, felt strips 84 are affixed to the interior circumference of the at the point of telescoping of its two sections to control air flow, to add friction, to stabilize the movable tube 102*b* inside the stationary tube 102*a*, and to reduce noise. The assembly 102 removably mounts at one end to a first vertical blade 104 of a U-shaped base 106 and passes through an opening 108 in a second vertical blade 110.

A putter 112 may be attached to the other end of the telescoping assembly 102 using a strap 114. The short putt module 100 permits a golfer to practice a straight putting stroke by moving the putter, thereby causing the end of the telescoping assembly 102 attached to the putter 112 to telescope toward and away from the U-shaped base 106 on a straight horizontal path, putting a ball 118 away from the U-shaped base 106. The ball 118 may be directed at a ball return wedge 120, which will receive the ball and return it to the vicinity of the golfer.

Figure 11:
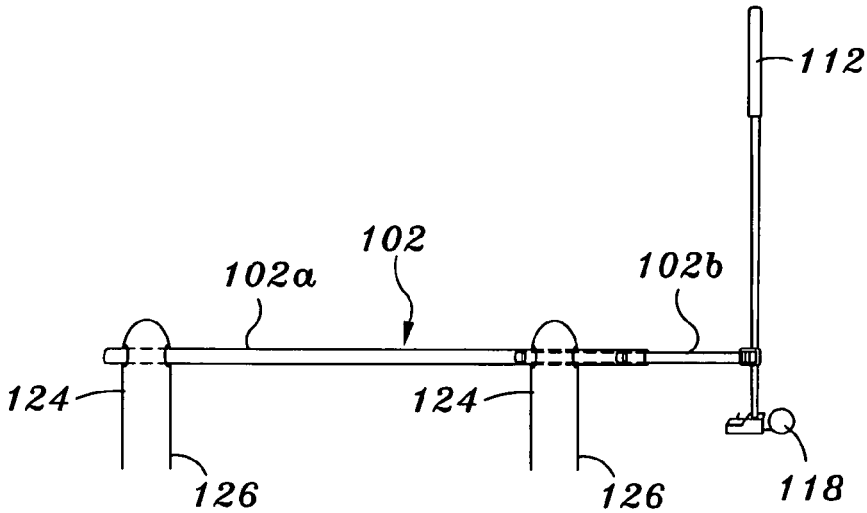
FIG. 11 is a perspective view of a short-putt module according to another embodiment.

As shown in FIG. 11, according to another embodiment the telescoping assembly 102 may be removed from the U-shaped base 106. By mounting the telescoping assembly 102 to two wire hoops 124, the user can press the lower ends 126 of the wire hoops 124 into the ground, and thereby set up the short-putt module 100. This embodiment permits the user to use the short-putt module 100 on a practice putting green or even while on a golf course.

Figure 12:
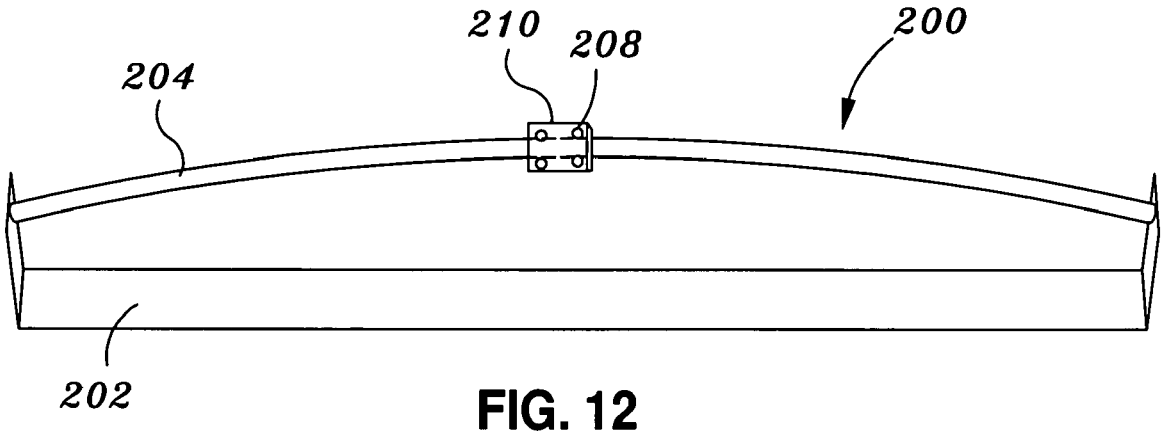
FIG. 12 is a perspective view of a long-putt module according to one embodiment.
Figure 13:
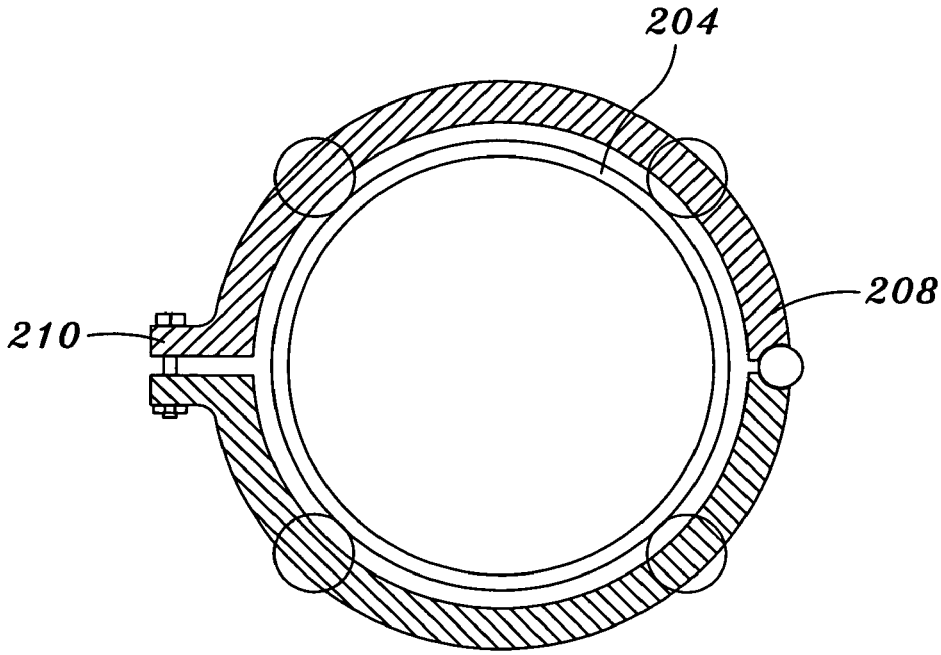
FIG. 13 is a cross-sectional view of putter attachment for the long-putt module.

As shown in FIG. 12, the present apparatus also includes a long-putt module 200. The long-putt module 200 includes a stand 202 with an arcuate guide 204 between the two ends of the stand 202. A bearing assembly 208, shown in FIG. 13, is moveably mounted on the arcuate guide 204 and has a slot 210 to which a putter may be attached. The arcuate guide is designed to simulate the arcuate path of a proper long putt putting stroke. By attaching a putter to the guide 204, a golfer may practice a putting stroke along the path of the arcuate guide and thus along the proper arcuate path of a long putting stroke that results from the required pivoting movement in longer putting situations.

According to another embodiment, the arcuate guide 204 may be removed from stand 202. By mounting the arcuate guide 204 to two wire hoops 124, the user can press the lower ends 126 of the wire hoops 124 into the ground, and thereby set up the long-putt module. This embodiment permits the user to use the long-putt module 200 on a practice putting green or even while on a golf course.

Figure 28:
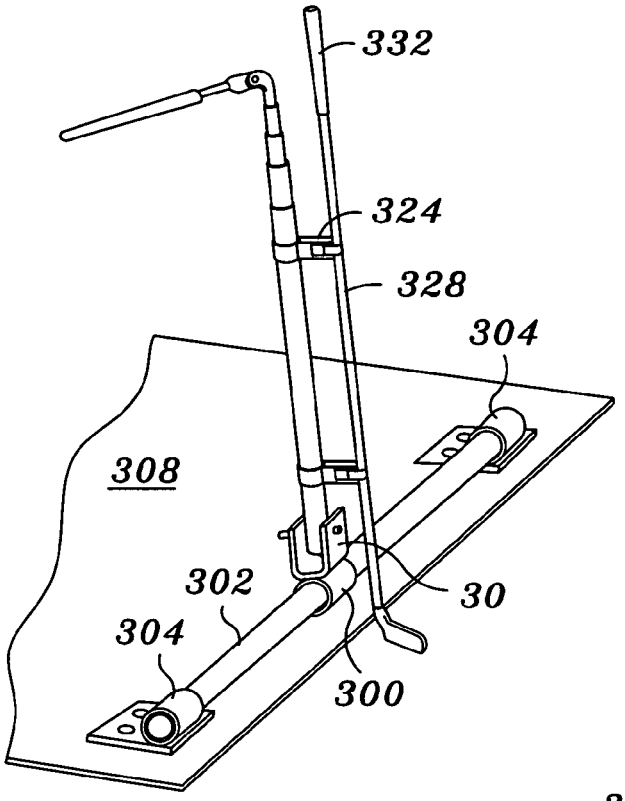
FIG. 28 is a perspective view of the driving module of FIG. 22 with a putting attachment.
Figure 29:
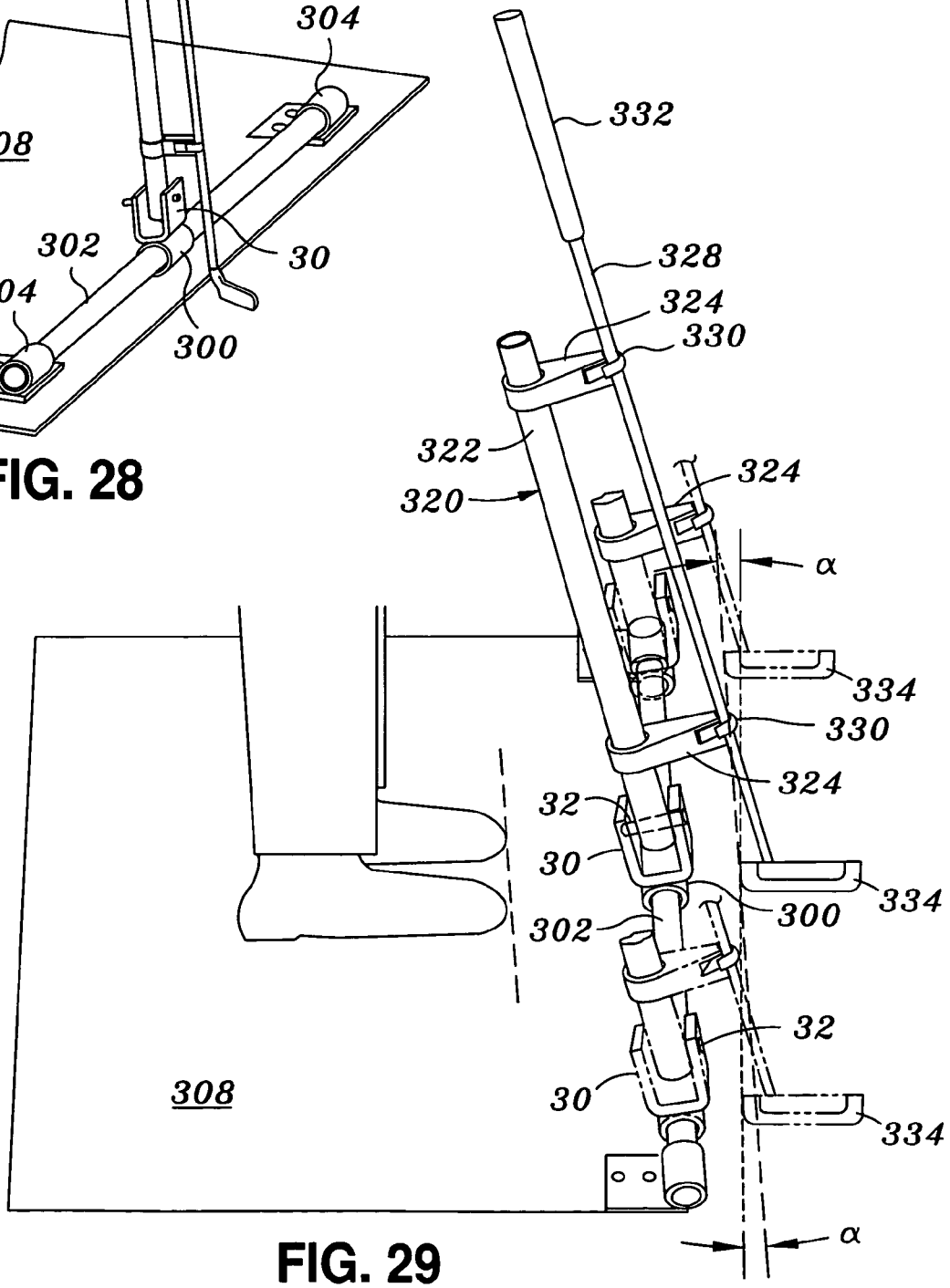
FIG. 29 is a side view of putter attachment on the horizontal bar connection showing a sliding bracket in three positions along the horizontal bar.

As depicted in FIGS. 28 and 29, according to yet another embodiment, a putting module 320 includes a guide column 322 slidably connected to a horizontal bar 322 using a U-shaped bracket 30 having a sleeve 300. The column 322 has connectors 324 that hold a putter 328 slightly away from the column. The connectors may be of various types, including the use of simple hook-and-loop fasteners 330. The column 322 is attached to the U-shaped bracket 30 using a single pivot pin 32, and so that the column and the putter are pivotally connected to the U-shaped bracket. In another embodiment shown in FIG. 28, the connectors 324 may be directly attached to the shaft 14, although in that embodiment the handle 20 might get in the golfer's way.

The sleeve 300 permits the U-shaped bracket 30 to glide along the length of the horizontal bar 302, as depicted in FIG. 29. The sliding of the sleeve allows a golfer to practice a putting stroke. In doing this, the putter 328 passes along an arc of a large circular swing.

In addition to being swung along an arc, the putter 328 is also swung along a specific plane. Due to the angle of the plane of the putter stroke, the putter moves slightly off from a purely vertical plane. That is, the putter goes up and in (toward the body of the golfer) from the bottom of the arc. The pivot point on the guide column 322 allows the putter handle 332 to stay pointed towards the center of the large circle, and in the same plane.

As shown in FIG. 29, this arcuate movement allows the club head 334 of the putter 328 to move slightly towards the golfer during both the backstroke and the follow-through. The amount of lateral movement (that is, movement perpendicular to the general direction of the putting stroke) is preferably about one-eighth of an inch in a twelve inch travel of the club head 334, resulting in a displacement angle $\alpha$ of approximately one degree. As a result, viewed from above, the horizontal bar 302 and the putting module assembly cause the putter head to move along the arc of the large circular motion of the stroke.

Although particular embodiments have been described, those of skill in the art will appreciate that various modifications and changes may be made by those skilled in the art without departing from the spirit and scope of the invention.

The invention claimed is:

1. A golf swing training apparatus having a driving module and a putting module, the driving module comprising:

a cylindrical handle configured to assist a user in properly gripping a golf club, the cylindrical handle having a first end connected by a mounting pin to at least one removable weight and a second end having a pivotal joint;

a longitudinal shaft attached at an upper end to the pivotal joint and pivotally and removably attachable at a lower end of the shaft to a U-shaped bracket, the shaft having multiple hollow cylindrical sections longitudinally and telescopically mounted therein for extensible and retractable sliding motion with respect to each other, each cylindrical section having upper and lower ends and a hollow interior, the lower end of each cylindrical section being configured to fit closely into the upper end of the adjacent section, the lower end of each of the sections having a cylindrical plug inserted into the hollow interior of that section, the lowest section forming the lower end of the shaft, and each section other than the lowest section having a felt strip about an exterior lower circumference of the respective section and each section other than an uppermost section having a felt strip about an interior upper circumference of the respective section, the felt strips designed to limit air flow into and out of the cylindrical sections when the shaft is telescopically extended or retracted;

a nylon cord affixed to the plug of the lowest section and passing through each of the plugs in the cylindrical sections to connect to the plug of the uppermost section; and the U-shaped bracket having first and second pivot points, the first pivot point being removably mounted to the longitudinal shaft with a quick release pin, the U-shaped bracket being slidably coupled to a horizontal bar along a central axis of the horizontal bar, the second pivot point extending about the central axis; and the putting module comprising:

a column pivotally and removably attachable to the U-shaped bracket; and at least one connector affixed to the column and having a means for detachably connecting a golf putting club to the column.

2. The apparatus of claim 1 wherein the pivotal joint permits pivoting between the cylindrical handle and the longitudinal shaft in only a single plane.

3. The apparatus of claim 1 further comprising a base connected to first and second ends of the horizontal bar and on which a user may stand when using the apparatus.

4. The apparatus of claim 1 further comprising a removable pin inserted into the horizontal bar to restrict movement of the longitudinal shaft.

5. The apparatus of claim 1 further comprising a clip removably mountable on the horizontal bar to restrict movement of the longitudinal shaft.

6. A golf driving training apparatus comprising:

a cylindrical handle having a first end and a second end including a pivotal joint;

a shaft attached at an upper end of the shaft to the pivotal joint and pivotally attached at a lower end of the shaft to a bracket, the shaft comprising multiple hollow longitudinally and telescopically mounted nested tubes for extensible and retractable sliding motion with respect to each other, each tube having an upper end and a lower end and a hollow interior, the lower end of each tube being configured to fit snugly into the upper end of the adjacent tube, the lowest tube forming the lower end of the shaft; and the bracket having first and second pivot points, the first pivot point being removably mounted to the shaft with a quick release pin, the bracket being slidably coupled to a horizontal bar along a central axis of the horizontal bar, and the second pivot point extending about the central axis.

7. The apparatus of claim 6 further comprising a mounting pin on the first end of the handle to permit mounting of at least one removable weight to the handle.

8. The apparatus of claim 6 further comprising a nylon cord affixed to the plug of the lowest tube and passing through each of the plugs in the cylindrical tubes to connect to the plug of the uppermost tube.

9. The apparatus of claim 6 wherein the pivotal joint permits pivoting between the cylindrical handle and the shaft in only a single plane.

10. The apparatus of claim 6 further comprising a plug inserted into the lower end of the lowest of the tubes.

11. The apparatus of claim 10 further comprising:

a plug inserted into the lower end of the uppermost tube; and a nylon cord affixed to the plug of the lowest tube and passing through each of the tubes to connect to plug in the uppermost tube.

12. The apparatus of claim 6 further comprising at least one felt strip about an exterior lower circumference of one of the tubes other than the lowest tube.

13. The apparatus of claim 6 further comprising at least one felt strip about an interior upper circumference of one of the tubes other than uppermost tube.

14. The apparatus of claim 6 further comprising felt strips about an exterior lower circumference of each tube other than the lowest tube; and felt strips about an interior upper circumference of each tube other than uppermost tube.

15. The apparatus of claim 6 further comprising a removable pin inserted into the horizontal bar to restrict movement of the longitudinal shaft.

16. The apparatus of claim 6 further comprising a clip removably mountable on the horizontal bar to restrict movement of the longitudinal shaft.

17. The apparatus of claim 6 further comprising a mounting pin on the first end of the handle to permit mounting of at least one removable weight to the handle.

18. The apparatus of claim 6 further comprising a base connected to first and second ends of the horizontal bar and on which a user may stand when using the apparatus.

* * * * *